US005186452A

United States Patent [19]

Holbrook

[11] Patent Number: 5,186,452

[45] Date of Patent: Feb. 16, 1993

[54] POWER STACKING APPARATUS

[75] Inventor: Russell W. Holbrook, Middlebury, Conn.

[73] Assignee: Pitney Bowes Inc., Stamford, Conn.

[21] Appl. No.: 803,275

[22] Filed: Dec. 5, 1991

[51] Int. Cl.[5] ..... B65H 31/06

[52] U.S. Cl. ..... 271/216; 271/179; 271/224

[58] Field of Search ..... 271/215, 216, 179, 185, 271/314, 224

[56] References Cited

U.S. PATENT DOCUMENTS

| | | | |
|---|---|---|---|
| 2,238,010 | 4/1941 | Breman | 271/87 |
| 2,841,394 | 7/1958 | Stobb | 271/87 |
| 2,843,378 | 7/1958 | Faeber | 271/87 |
| 3,131,932 | 5/1964 | Maidment | 271/87 |
| 3,700,232 | 10/1972 | Wiegert et al. | 271/75 |
| 3,865,365 | 2/1975 | Hardin et al. | 271/214 |
| 3,945,635 | 3/1976 | Marin | 271/216 X |
| 4,200,016 | 4/1980 | Helmig et al. | 83/88 |
| 4,252,308 | 2/1981 | Templeton | 271/179 |
| 4,428,573 | 1/1984 | Denison, III et al. | 271/305 |
| 4,474,365 | 10/1984 | DiBlasio | 271/3 |

FOREIGN PATENT DOCUMENTS 3246112 7/1983 Fed. Rep. of Germany .

*Primary Examiner*—Richard A. Schacher

*Attorney, Agent, or Firm*—Charles G. Parks, Jr.; Melvin J. Scolnick

[57] ABSTRACT

A power stacker for collecting delivered articles such as envelopes from a mailing machine is comprised of a support housing having a deck fixably mounted along the housing. A registration wall is fixably mounted to the housing and extending generally perpendicular relative to the deck. A stack wall is slidably mounted to the housing at one end of the deck and has a reclined surface extended generally upwardly from the deck, the stack wall being slidably mounted to the housing such that the stack wall can be horizontally displaced relative to the deck. Support rods are provided for providing article support between the deck and displaced stack wall as well as between the registration and displaced stack wall. Threaded hubs are provided for causing the delivered articles to be collected against the stack wall and assume a generally parallel stacked orientation generally parallel to the reclined surface. A power stack wheel assembly is supported in a cantilevered fashion from the registration wall. Stack wheels are overrunning on a clutch until power to climb envelope lead edges is needed.

6 Claims, 7 Drawing Sheets

POWER STACKING APPARATUS

RELATED APPLICATION

This application is related to U.S. patent application Ser. No. 565,878 filed on Aug. 13, 1990, and entitled POWER STACKING APPARATUS.

BACKGROUND OF THE INVENTION

This invention relates to a power stacking apparatus for receiving a stream of articles and causing the articles to be placed in a stack, and, more particularly, to a power stacking apparatus for receiving a seriatim stream of envelopes discharged from a postage meter mailing machine.

A power stacking apparatus has been developed particularly suited for receiving envelopes delivered in a seriatim manner from a mailing machine. Generally, the power stacker is comprised of a support housing having a deck fixably mounted along the housing. A registration wall is fixably mounted to the housing and extends generally perpendicular relative to the deck. A stack wall is slidably mounted to the housing at one end of the deck and has a reclined surface extending generally upwardly from the deck. The stack wall is slidably mounted to the housing such that the stack wall can be horizontally displaced relative to the deck. Support rods are provided for providing article support between the deck and displaced stack wall as well as between the registration and displaced stack wall. Threaded hubs are provided for causing the delivered articles to be collected against the stack wall and assume a generally parallel stacked orientation generally parallel to the reclined surface.

It is the intent of the power stacker to receive envelopes from the mailing machine on the stacker deck in a shingled manner. Transport belts with the assistance of a friction stack wheel transport the shingled envelopes to the threaded hubs. The threaded hubs engage the respective envelopes to forcibly cause the envelope to assume a generally vertical biased position against the stack wall. The collection of envelopes against the stack wall causes the stack wall to journey outward in response to forced engagement of the envelopes. It is the further intent of the power stacker to stack mix sized mail of varying thickness of up to three quarter of an inch. It has been empirically determined that the performance of the power stacker to consistently stack mixed envelopes of varying thickness of up to three quarter of an inch was unsatisfactory. For example, when stacking three quarter inch thick envelopes, it has been observed that the envelope became lodged at the stack wheel.

SUMMARY OF THE INVENTION

It is an object of the present invention to present a power stacking apparatus having improved stacking capability wherein the power stacking apparatus includes a power stack wheel which improves the consistency of the power stacker to stack envelopes of varying size and thickness.

The power stacker is comprised of a base section supporting a deck such that the deck is placed at a rearwardly reclining angle of approximately 15° (fifteen degrees). A registration wall is fixably mounted generally vertical along the rear wall of the power stacker such that the registration wall assumes a generally perpendicular orientation with respect to the deck. The deck includes a plurality of parallel aligned endless belts placed around a respective pair of friction rollers for transporting envelopes across the deck.

A plurality of threaded hubs (augers) are rotatively mounted to the deck such that each hub extends partially through a recess formed in the deck. A gear assembly is mounted in the housing in driven communication with a motor mounted in the housing for driving the augers. An additional threaded hub or auger is rotatively mounted to the registration wall such that a portion extends through a slot formed in the registration wall and is also in driven communication with the motor through an endless belt.

A stack wall is displacably mounted to one end of the housing on slide rods. The stack wall includes a forward reclined surface extending generally vertically from the deck.

The power stacker further includes a power stack wheel pivotally mounted to the registration wall to apply downward pressure on the shingled envelopes displaced along the deck as the envelope passes beneath the stack. It has been determined that the stacking is best accomplished by rotating the stack wheel at a linear rate equal to the belt transport rate. The stack wheel is supported by a housing containing a motor which drives the stack wheel through a slip gear arrangement. The motor drives the stack wheel at a speed approximately ten percent slower than the speed of the transport belts. The slip gear arrangement only allows the motor the stack wheel when the speed of the stack wheel has sufficiently dropped below that of the belts which occurs when an envelope has become lodged. The driving action of the stack wheel then causes the envelope to proceed. However, under normal conditions, the stack wheel is allowed to over ride the motor through the slip clutch.

The transported envelopes under the influence of the belts transport and powered stack wheel are then delivered to the stack wall whereupon the threaded hubs engage the envelopes. The hub engagement of the envelopes forcibly causes the respective envelopes to assume a generally vertical biased position against the stack wall causing the stack wall to journey outward in response to forced engagement of the envelopes.

Other benefits and advantages of the present invention will be noted or be apparent to one reasonable skilled in the art upon a reading of the following detailed description of the preferred embodiment of the invention.

DETAILED DESCRIPTION OF THE PREFERRED EMBODIMENT

Figure 1:
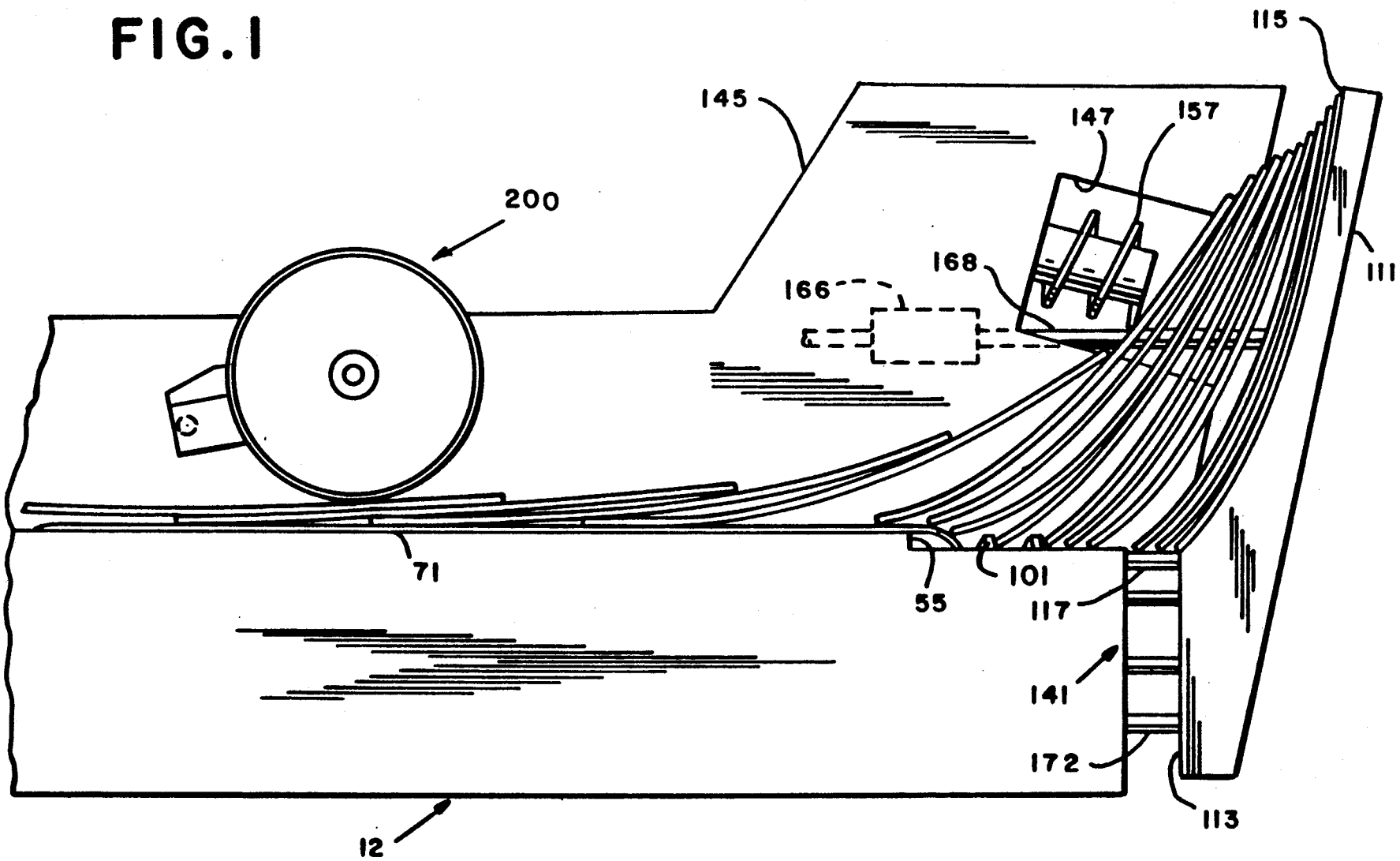
FIG. 1 is a partial side view of a power stacker in accordance with the present invention.

Referring to FIGS. 1 through 4, a power stacker, generally indicated at 11, particularly suited to the present invention is comprised of a base housing 12 having a base 13. A plurality of vertically extending support posts 15 and 17 (support post 17 shown in FIG. 3) are fixably mounted to base 13 at one end. The base 13 also has fixably mounted thereto in vertical alignment, a forward wall 21 and rear wall 23 in transversely spaced apart parallel alignment. End walls 25 and 27 are fixably mounted to the base 13 in spaced apart relationship and at there ends to respective walls 21 and 23.

A deck is fixably mounted to walls 21, 23, 25 and 27 and along its underside to the support posts 15 and 17, such that the deck assumes a reclined position, front to rear, of approximately 15. (fifteen degrees) from the horizontal. A deck 31 contains a plurality of slots 33, 35, and 37. Fixably mounted to the underside of the deck 31 at the receiving or forward end is a first and second adjustable tension brace assemblies 41 and 43. Also fixably mounted to the underside of the deck 31 are braces 45. The braces 45 are longitudinally aligned to a respective brace assembly 41 and 43.

Fixably mounted to the underside of deck 31 is a motor mount 48 having a motor 49 mounted thereto. The motor 49 includes an output shaft 51 having a pulley gear 52 fixably mounted around the output shaft 51. A shaft 53 carrying a plurality of fixably mounted friction wheels 55, 57, and 59 therearound is rotatively mounted in the braces 45. The friction wheels are radially aligned to respective first slots 33, 35 and 37. A second shaft 63 is rotatively mounted in brace assemblies 41 and 42. The shaft 63 carries a plurality of friction wheels 65, 67 and 69 radially aligned to the respective second slots 33, 35 and 37. A plurality of endless belts 71, 73 and 74 extend around the respective friction wheel pairs 55–67, 59–65 and 57–69.

The shaft 53 further includes a pulley gear 81 which is in endless belt communication with the motor 49 for providing driving force to shaft 53. The shaft 53 further includes bevel gears 85 and 87 fixably mounted therearound in axial spaced apart relationship. The rear wall 23 includes an aperture 89 through which an end portion of the shaft 53 extends and has fixably mounted therealong a pulley 91.

End wall 25 has formed thereon a plurality of studs 91 and 93 through which extends a respective shaft 95 and 97 seated at one end in the end wall 25. Rotatively mounted around the other end of shafts 95 and 97 is a respective threaded hub 101 and 103. The threaded hubs 101 and 103 are mounted such that the threaded hubs 101 and 103 partially extend into respective recesses 104 and 106 formed into the deck 31. A bevel gear 92 and 93 is rotatively mounted around the respective shafts 95 and 97 in driving communication with the respective threaded hubs 101 and 103. The bevel gears 92 and 93 are in constant mesh With respective bevel gears 85 and 87.

Figure 2:
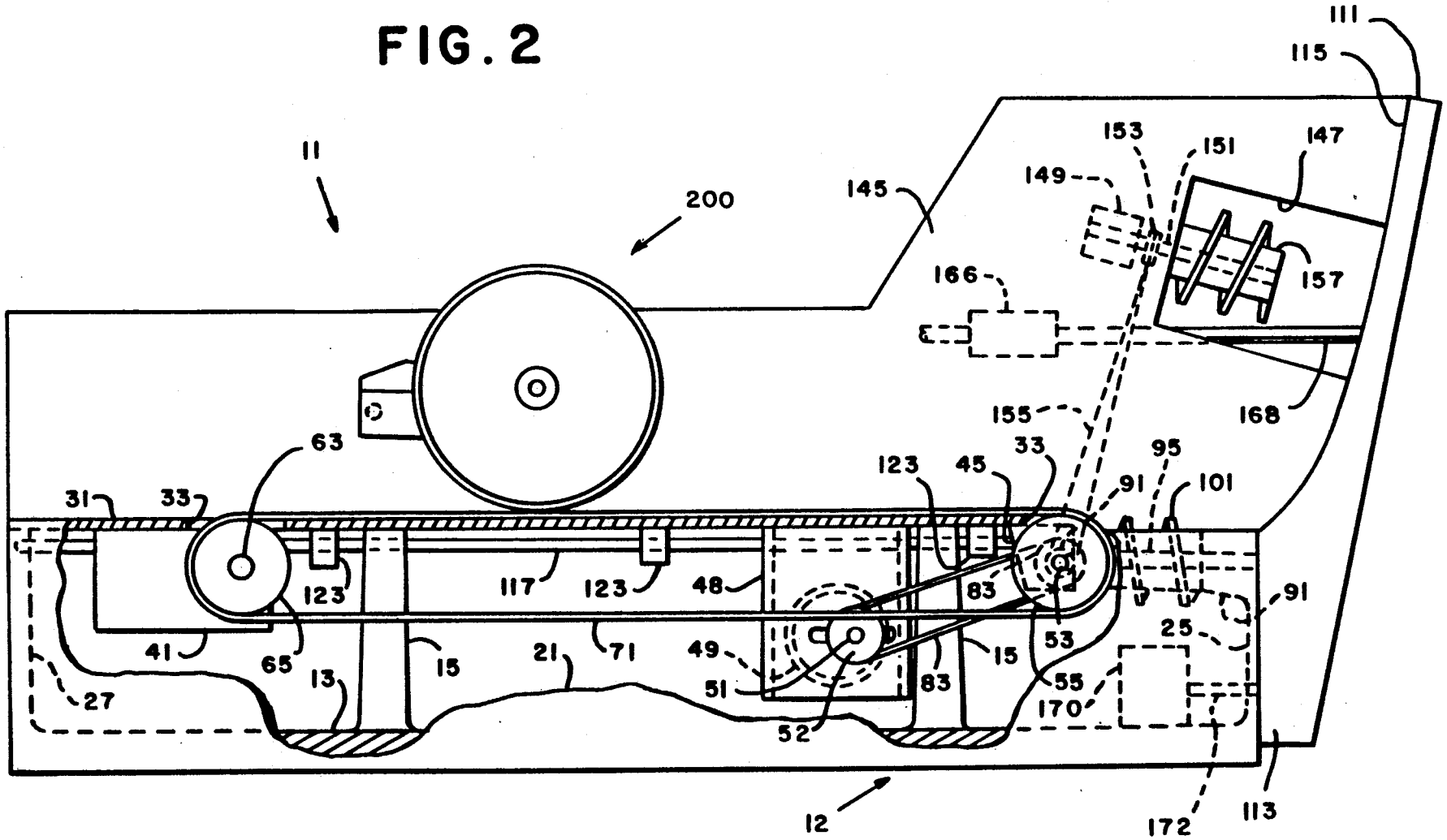
FIG. 2 is a sectioned side view of the power stacker.
Figure 3:
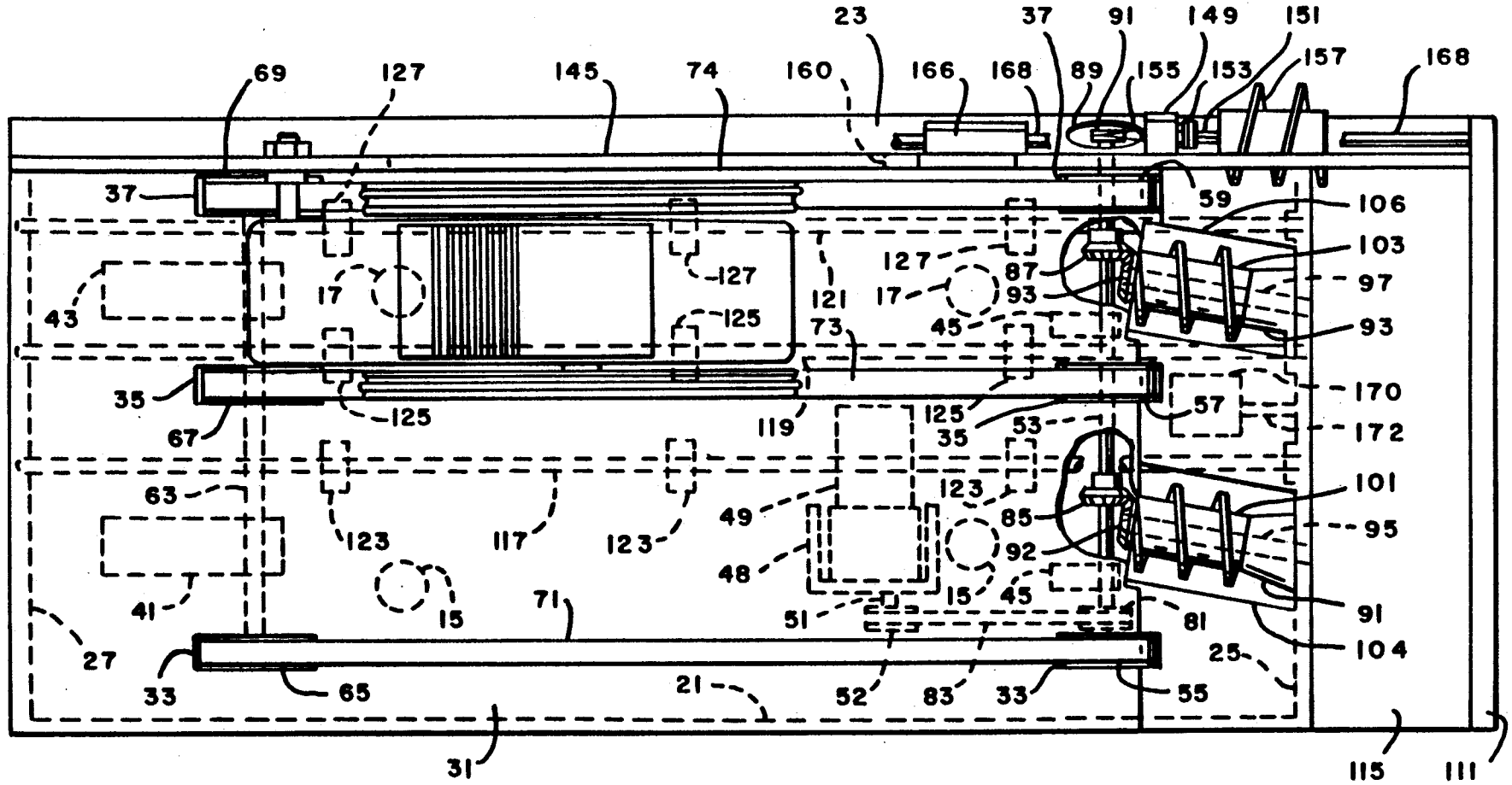
FIG. 3 is a top view of the power stacker.
Figure 4:
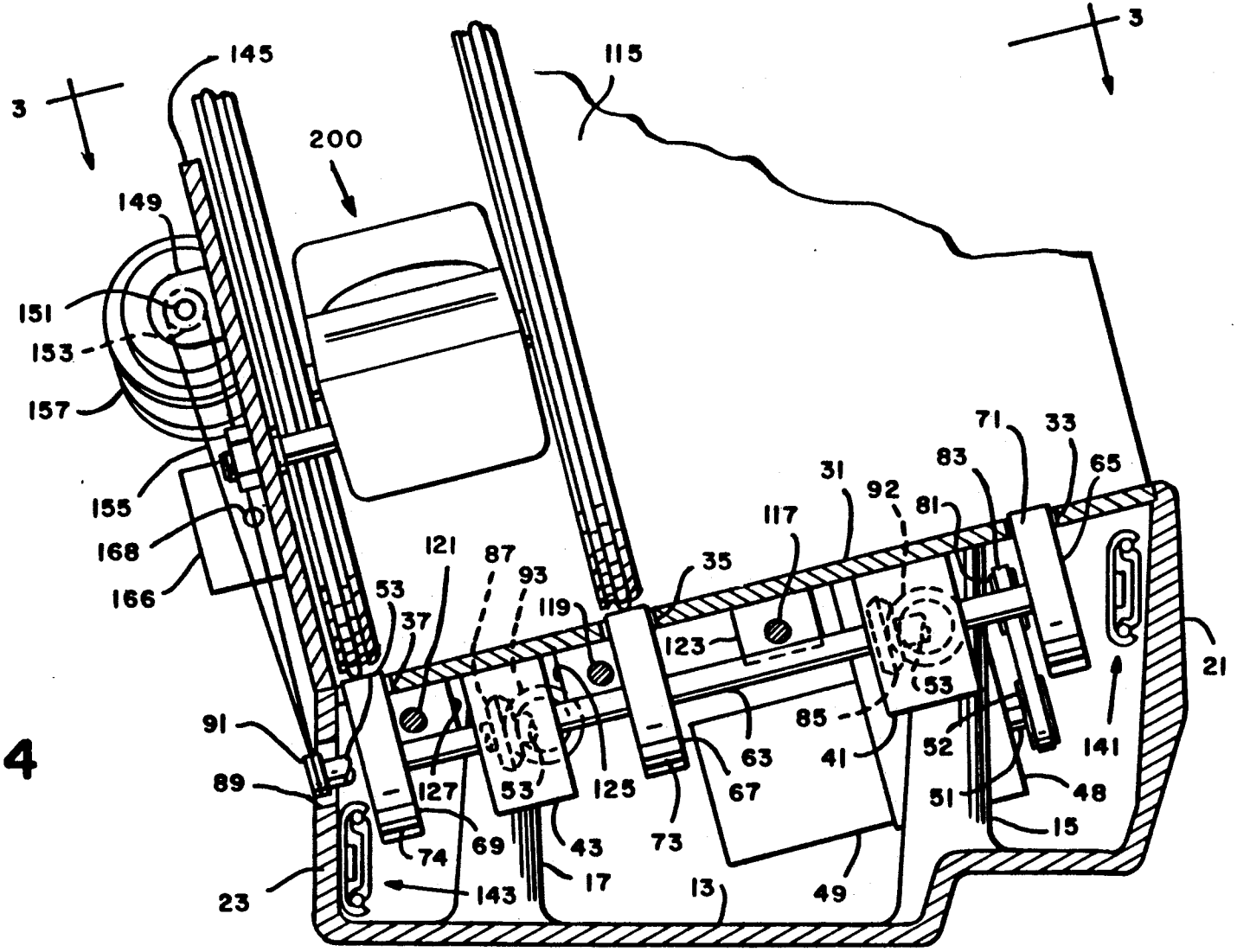
FIG. 4 is a sectioned end view of the power stacker.

A stack wall 111 has a formed facing surface 113 abutting to the outer face of end wall 25 vertically leading to a vertically reclined surface 115. A plurality of guide rods 117, 119 and 121 are fixably mounted at one end to the facing surface of the stack wall 111. The guide rods 117, 119 and 121 extend slidably through respective apertures in the end wall and are slidably received by respective guide tabs 123, 125 and 127. The guide tabs 123, 125 and 127 are fixably mounted to the underside of the deck. Referring particularly to FIGS. 2 and 4, slide rail assemblies 141 and 143 having a rail portion is fixably mounted to the respective side walls 21 and 23. Another rail portion of rail assemblies 141 and 143 are fixably mounted at one end to the facing surface 113 of the stack wall 111 such that the stack wall 111 can be longitudinally displaced relative to end wall 27.

Referring more particularly to FIGS. 2 and 4, a registration wall 145 is fixably mounted longitudinally along the rear wall 23 and orientated generally perpendicular to the deck. The registration wall 145 includes a recess 147 angled generally perpendicular to the reclined surface 115 of stack wall 111. A brace 149 is fixably mounted to the back surface of the registration wall 145. The brace 149 includes a shaft 151 rotatively mounted therein such that the shaft 151 extends generally perpendicular to the recline surface 115 of the stack wall 111. A pulley 153 is fixably mounted to the end of shaft 151. The pulley 153 is an endless belt 155 in driven communication with the pulley 91 mounted shaft 63. A threaded hub 157 is fixably mounted around the shaft 151.

Figure 6B:
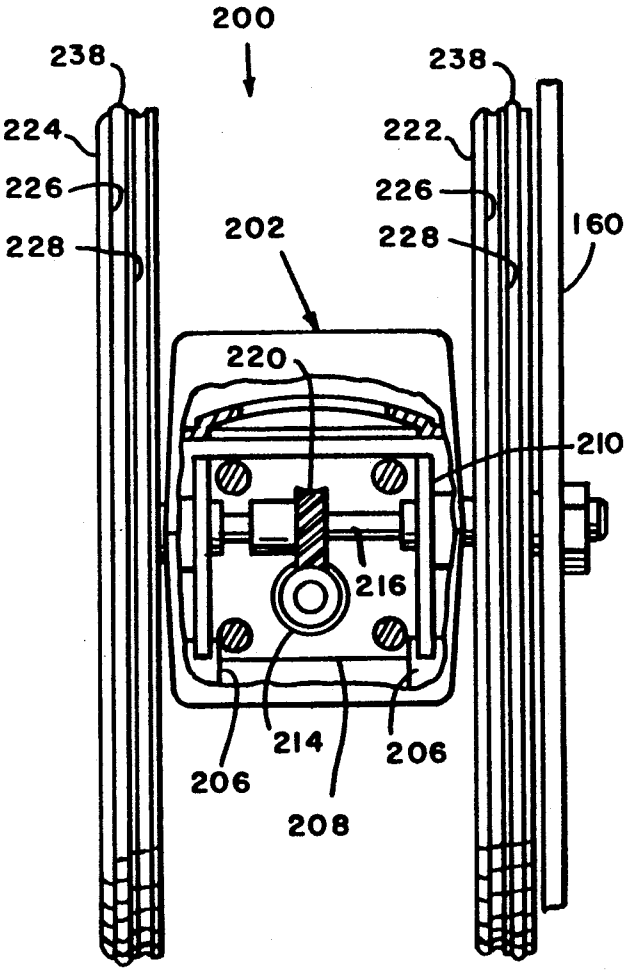
FIGS. 6A and 6B are a side and frontal views, respectively, of the power stack wheel in accordance with the present invention.
Figure 6A:
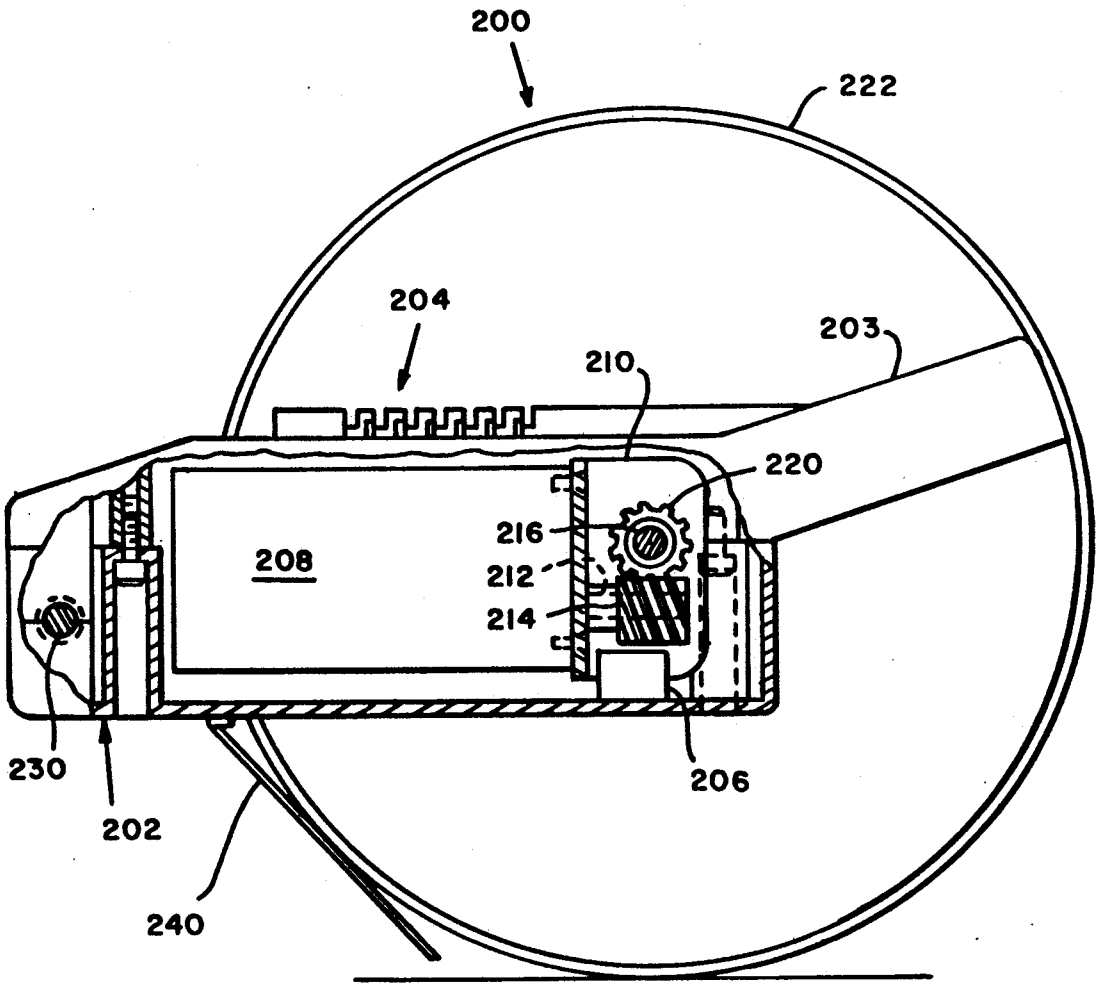
Figure 7:
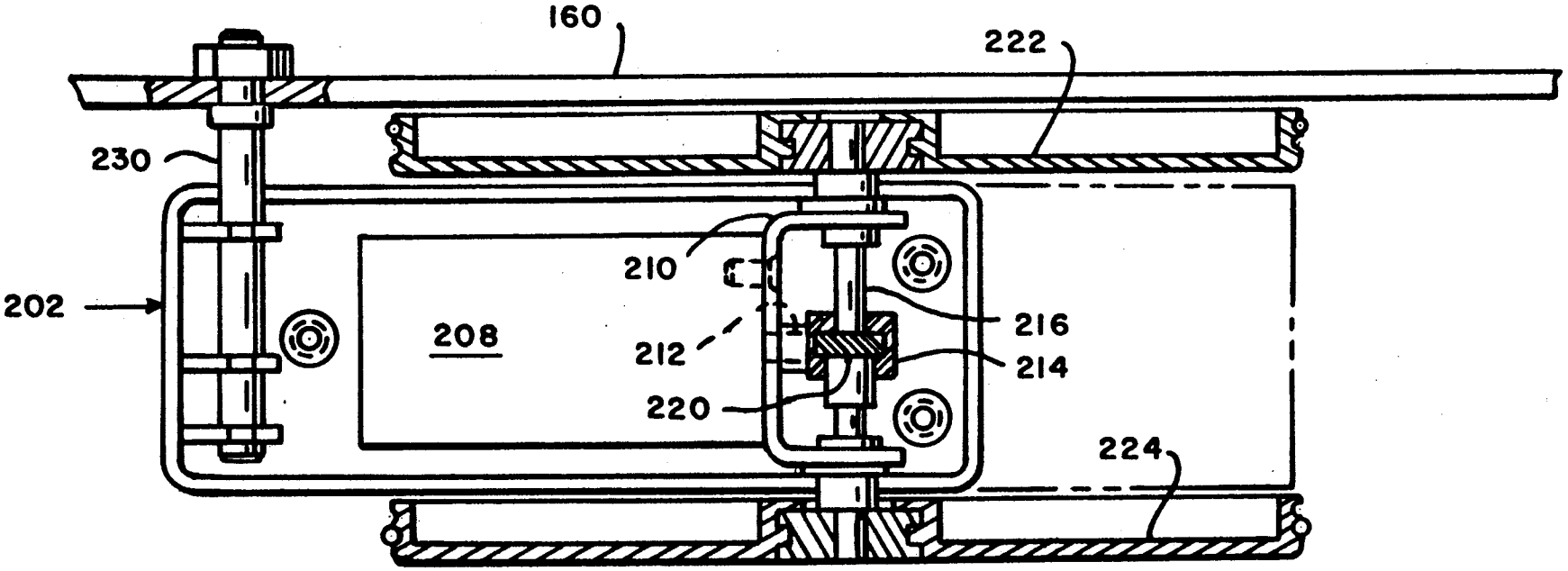
FIG. 7 is a schematic top view of the power stack wheel.

Referring to FIGS. 6A, 6B, and 7, the stacker wheel assembly 200 is comprised of a housing 202 having a plurality of motor cooling vents 204. The housing 202 also includes a spacing section 203. Fixably mounted inside the housing 202 by any conventional means, such as, by support tabs 206, is a motor 208. The motor 208 includes a forward bracket 210 and an output shaft 212. The output shaft 212 has fixably mounted therearound a worm gear 214. Rotatably mounted to the bracket 210 by any conventional means is a shaft 216 such that respective end portion of the shaft 216 extends through aligned apertures in the housing 202. Mechanically coupled to the shaft 216 is a one way wrap spring clutch and worm gear combination 220 of any suitable conventional construction, (hereafter collectively referred to as worm gear 220. The worm gear 220 is located along the shaft 216 to be in constant mesh with the worm gear 214. At one end of the shaft 216 outboard of the housing 202 is fixably mounted by any conventional means is a first wheel 222. A second wheel 224 is fixably mounted to the other end of shaft 216 outboard of the housing 202. Each of the wheels 222 and 224, respectively, includes a first canal 226 and a second canal 228 which canals respectively extend endlessly around the respective wheel 222 and 224.

A shaft 230 extends through the registration wall 160 and is fixably and detachably mounted at one end to the registration wall 160. The housing 202 is pivotally supported by the shaft 230 in a cantilever fashion such that the wheels 224 ride on deck 31 when no envelope is present.

Figure 5:
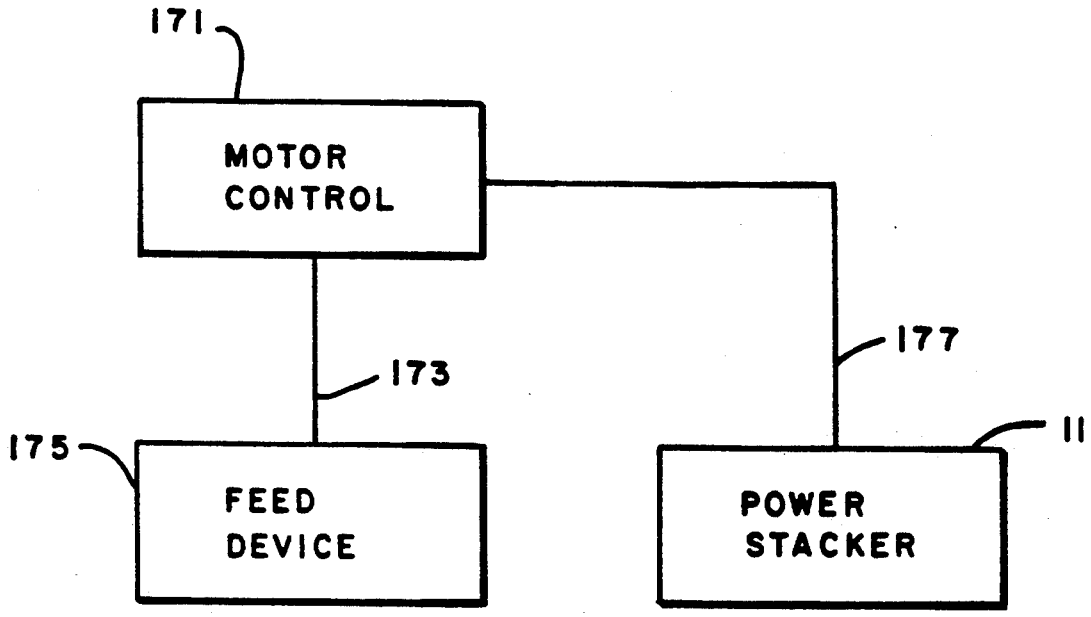
FIG. 5 is a schematic of a power stacker motor control in accordance with the present invention.

Referring to FIGS. 1, 2 and 5, in operation, a suitable motor controller 171 is in electrical communication through line 173 with an envelope feed device 175, for example, a mailing machine, and through line 177 with the motor 49 of the power stacker 12. The motor controller 171 synchronously controls the operating speed of the power stacker 11 and the feed device 175 such that envelopes, for example, 5 inch envelopes delivered by the feed device are received by the power stacker in a shingled fashion with approximately a 0.75 inch spacing between the leading edges of successive envelopes. The envelopes are transported by the belts 55, 57 and 59, which are under the drive influence of motor 49 through belt 83 and shaft 53, under the stacker wheel assembly 200. The motor controller 171 also causes the motor 208 obtain a speed of approximately ten percent (10%) slower than the drive speed of the endless belts. Thus, the one way (wrap spring) clutch associated with worm gear 220 is in an overrunning mode when no mail is present, or when the bottom endless belts do not slip on the shingled envelopes. When a thick mailpiece (i.e., ¼" or greater) is fed into the stacker deck, the tendency for it to stall upon entering the nip of the stack wheel. Thus, when the mailpiece stalls or slows the speed of the stack wheels below ten percent of the bottom belts, the clutch engages and transmits motion to the mailpiece moving it downstream (the clutch engages to allow the wheels to "climb" the thick mailpieces, lead edge).

The leading edge of the lead envelopes is then caused to engage the stack wall facing 115 and thereafter assume a generally vertical position against the stack wall. The subsequent envelopes are caused to assume a generally parallel orientation relative to the lead envelope. The positioning of envelopes is assisted by the edge engagement of the envelopes with the threaded hubs 101, 103 and 157.

As the envelopes are caused to Vertically stack, edge engagement of the envelopes with the threaded hubs 101, 103 and 157 cause the stack wall 111 to displace outwardly. The rods 117, 119, 121 and 168 support the stacked envelopes as the stack wall is displaced.

Referring particularly to FIG. 6B, it is noted that in the preferred embodiment, each stacker wheel 222 and 224 includes a respective set of canals 226 and 228. Residing in one of the canal 226 or 228 in each stacker wheel 222 and 224 is an O-ring 238. The stacker wheel 222 is located in close proximity to the registration wall 160 and the stacker wheel 224 spaced apart from the stacker wheel 222 so as not to contact the printed indicia on an envelope passing below the stacker wheels 222 and 224. The placement of the O-ring 238 in the respective canals 226 or 228 on the respective stacker wheels 222 and 224 is provided for proper contact with an envelope passing below the stacker wheels. This flexibility is beneficial in that is allows accommodation to the requirement for indicia location as prescribed by various countries. To further illustrate the preferred embodiment of the present invention, a deflector 240 is mounted to the housing 202 by any conventional means in such manner as to permit the deflection between the stack wheels 222 and 224.

The afore description is of the preferred embodiment of the present invention and should not be viewed as limiting to the invention. The scope of the invention is defined by the appendix claims.

What is claimed is:

1. A power stacker for collecting delivered articles including a housing having a transport deck, a registration wall mounted to and supported by said deck generally perpendicular to said deck, a stack wall slidably mounted to said housing at one end of said deck and means for transporting articles across said deck in a shingled manner and causing said article to vertically align and be biased against said stack wall, further comprises:

a power stacker wheel assembly having a motor housing, a motor mounted in said motor housing, a stacker wheel rotatively mounted to said motor housing, transmission means for providing driving communication from said motor rotation to said stacker wheel to cause rotation of said stacker wheel, said power stacker wheel assembly being mounted to said power stacker such that an envelope transported on the deck of said power stacker is caused to pass below said stacker wheel.

2. An improved power stacker for collecting delivered envelopes including a housing having a transport deck, a registration wall mounted to and supported by said deck generally perpendicular to said deck, a stack wall slidably mounted to said housing at one end of said deck and drive means for transporting envelopes across said deck in a shingled manner and causing said envelopes to vertically align and be biased against said stack wall, said drive means being under the control of a microcontroller, wherein said improvements comprises:

a motor housing pivotally mounted in a cantilevered fashion to said registration wall;

a motor having an output shaft mounted in said motor housing;

a plurality of stacker wheels rotatively mounted to said motor housing;

clutched transmission means for providing driving communication from said motor output shaft to said stacker wheels to cause rotation of said stacker wheels when said rotational speed of stacker wheel is less than said drive means;

said power stacker wheel assembly being mounted to said power stacker such than an envelope transported on the deck of said power stacker is caused to pass below said stacker wheels.

3. An improved power stacker as claimed in claim 2 further comprising said motor being in line communication with said motor controller such that said stack wheels are caused to rotate at a speed less than the displacement speed of said drive means.

4. An improved power stacker as claimed in claim 3 further comprising each of said stack wheels having a plurality of formed canals therearound and having an O-ring residing in a select one of said canals.

5. An improved power stacker for collecting delivered envelopes including a housing having a transport deck, a registration wall mounted to and supported by said deck generally perpendicular to said deck, a stack wall slidably mounted to said housing at one end of said deck and drive means for transporting envelopes across said deck in a shingled manner and causing said envelopes to vertically align and be biased against said stack wall, said drive means being under the control of a microcontroller, wherein said improvements comprises:

a motor housing pivotally mounted in a cantilevered fashion to said registration wall;

a motor having an output shaft mounted in said motor housing;

a plurality of stacker wheels rotatively mounted to said motor housing, each of said stack wheels having a plurality of formed canals therearound and having an O-ring residing in a select one of said canals, said stacker wheels being spaced apart such that said O-ring contacts an envelope passing below said stacker wheel outboard of a printed indicia;

transmission means for providing driving communication from said motor output shaft to said stacker wheels to cause rotation of said stacker wheels only when said rotational speed of said stack wheel is less than said drive means;

said power stacker wheel assembly being mounted to said power stacker such than an envelope transported on the deck of said power stacker is caused to pass below said stacker wheel.

6. An improved power stacker as claimed in claim 5 further comprising said motor being in line communication with said motor controller such that said stack wheels are caused to rotate at a speed less than said displace speed of said drive means when said stack wheels are stalled by a transported envelope.

* * * * *